United States Patent [19]

Singhal et al.

[11] 4,434,043

[45] Feb. 28, 1984

[54] RECOVERY OF CATALYST FROM COAL LIQUEFACTION RESIDUES

[75] Inventors: Gopal H. Singhal, Houston; Ramachandra A. Nadkarni, Baytown, both of Tex.

[73] Assignee: Exxon Research and Engineering Co., Florham Park, N.J.

[21] Appl. No.: 383,901

[22] Filed: Jun. 1, 1982

[51] Int. Cl.[3] ..... C10G 1/06; C10G 1/00

[52] U.S. Cl. ..... 208/10; 208/8 LE; 208/11 LE

[58] Field of Search ..... 208/8 LE, 10

[56] References Cited

U.S. PATENT DOCUMENTS

| | | | |
|---|---|---|---|
| 3,539,290 | 11/1970 | Erickson et al. . | |
| 3,657,108 | 4/1972 | Kiovsky et al. | 208/10 |
| 3,813,329 | 5/1974 | Gatsis . | |
| 3,923,634 | 12/1975 | Silvestri et al. . | |
| 4,102,774 | 7/1978 | Carr et al. | 208/10 X |
| 4,224,137 | 9/1980 | Schroeder . | |
| 4,239,613 | 12/1980 | Schulz | 208/8 LE |
| 4,278,443 | 7/1981 | Beuther et al. | 208/8 LE |

FOREIGN PATENT DOCUMENTS

| | | | |
|---|---|---|---|
| 463602 | 4/1937 | United Kingdom | 208/10 |

*Primary Examiner*—William G. Wright

*Attorney, Agent, or Firm*—Yale S. Finkle

[57] ABSTRACT

Metal constituents are recovered from the heavy bottoms produced during the liquefaction of coal and similar carbonaceous solids in the presence of a catalyst containing metal constituents by reducing the carbonaceous content of the heavy bottoms, contacting the resultant heavy bottoms deficient in carbonaceous material with an aqueous solution of a mineral acid in the presence of an added alcohol and an added oxidizing agent to extract the metal constituent from the insoluble catalyst residues into the aqueous solution, and using the metal constituents extracted as constituents of the catalyst. Preferably, the metal constituent comprising the catalyst is molybdenum, the mineral acid is sulphuric acid, hydrochloric acid or phosphoric acid, the oxidizing agent is hydrogen peroxide and the alcohol is methanol. In a preferred embodiment of the invention, the carbonaceous content of the heavy bottoms is reduced by subjecting the heavy bottoms to a solvent extraction at elevated temperature and pressure with a hydrocarbon solvent in the presence of molecular hydrogen.

15 Claims, 1 Drawing Figure

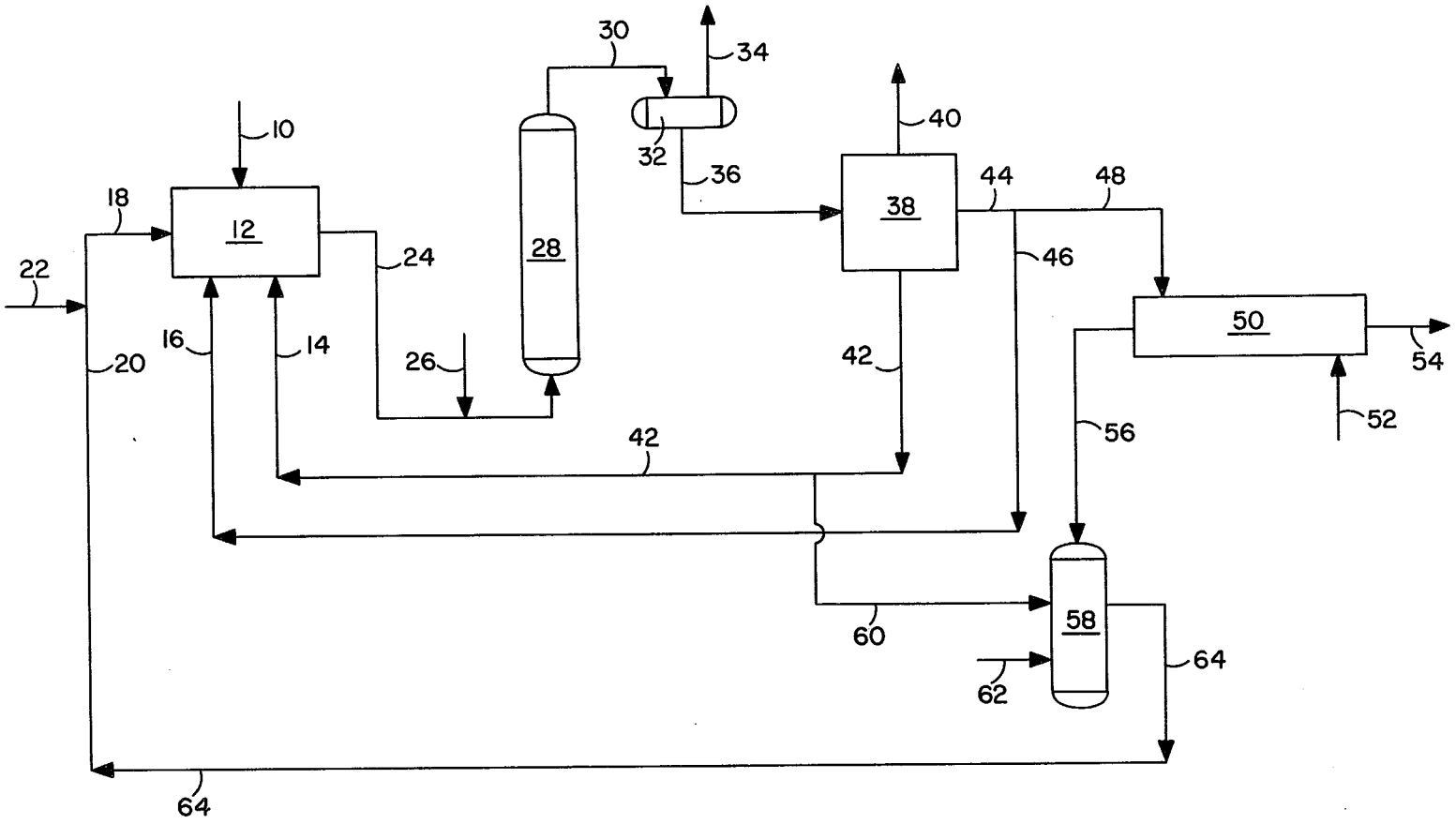
10
12
14
16
18
20
22
24
26
28
30
32
34
36
38
40
42
42
44
46
48
50
52
54
56
58
60
62
64
64

RECOVERY OF CATALYST FROM COAL LIQUEFACTION RESIDUES

BACKGROUND OF THE INVENTION

This invention relates to the liquefaction of carbonaceous solids such as coal in the presence of a metal-containing liquefaction catalyst, and is particularly concerned with the recovery of the metal constituents from the residues produced during the liquefaction process and their reuse as constituents of the metal-containing catalyst.

Processes for the direct liquefaction of coal and similar carbonaceous solids normally require contacting of the solid feed material with a hydrocarbon solvent and molecular hydrogen at an elevated temperature and pressure to break down the complex high molecular weight hydrocarbon starting material into lower molecular weight liquids and gases. Schemes for employing catalyst to promote the liquefaction and hydrogenation of coal in such processes have been disclosed in the prior art. Metals known to be effective catalytic constituents include cobalt, iron, manganese, molybdenum and nickel. These metals may be added directly into the liquefaction zone in the form of water-soluble or oil-soluble compounds, or compounds containing the metals can be directly impregnated onto the carbonaceous feed material. In some cases, the metal-containing compound may be added to the liquefaction zone in the form of a supported catalyst by impregnating the metal-containing compound onto an inert support such as silica or alumina. Since the metals that comprise the catalyst which is eventually formed in the liquefaction zone tend to be expensive, it is necessary to recover the metal constituents for recycle to the liquefaction zone.

Processes have been proposed in the past for separating the metal catalyst constituents from the solid residue of carbonaceous material left after the feed has been converted in the liquefaction zone and the products processed for the recovery of liquids. In one such process it is proposed to pass the liquefaction residue to a synthesis gas generator to produce molten ash containing the catalyst constituents and then treating the molten ash with chlorine or oxygen to convert the metal catalyst constituents to a volatile compound which can be easily recovered. This process is undesirable because of the high temperatures needed to generate the molten ash and volatilize the catalyst constituents. It has also been proposed to recover the metal catalyst constituents by treating the residues from the liquefaction zone with a liquid solution of phosphoric or silicic acid to form a heteropoly acid which can then be reused as a catalyst. The extraction with the phosphoric or silicic acid can be carried out directly on the residues from liquefaction, or the residues may first be subjected to a carbonization step followed by burning to produce a char that is then treated with the acid solution. This procedure, however, will not result in complete recovery of the metal catalyst constituents.

SUMMARY OF THE INVENTION

The present invention provides an improved process for the recovery of metal constituents from carbonaceous residues produced during the liquefaction of coal and similar carbonaceous solids carried out in the presence of a metal-containing catalyst. In accordance with the invention, it has now been found that large amounts of the metal constituents comprising the catalyst can be effectively recovered from the heavy bottoms stream containing carbonaceous material, insoluble metal-containing catalyst residues and ash produced during the liquefaction of coal and similar carbonaceous materials carried out in the presence of a catalyst containing active metal constituents by reducing the organic or carbonaceous content of the bottoms and then contacting the resultant bottoms deficient in carbonaceous material with an aqueous solution of a mineral acid in the presence of an added alcohol and an added oxidizing agent to extract the metal constituents from the insoluble catalyst residues in the bottoms. The extracted metal constituents are then reused as constituents of the liquefaction catalyst. Normally, this is accomplished by mixing the aqueous solution from the acid extraction step with a hydrocarbon liquid in the presence of an extraction agent which transfers the metal constituents from the aqueous phase into the hydrocarbon phase and then recycling the hydrocarbon liquids to the liquefaction zone. The liquefaction of the carbonaceous solids in the presence of the metal-containing catalyst will normally be carried out by contacting the solids with molecular hydrogen and an added hydrocarbon solvent. In some cases when molecular hydrogen is used, however, an added solvent may not be required.

In a preferred embodiment of the invention, the organic content of the heavy bottoms stream containing carbonaceous material, insoluble metal-containing catalyst residues and ash is reduced by extracting the heavy bottoms with a liquid hydrocarbon solvent. Preferably, the solvent is a hydrogen-donor solvent and the extraction is carried out in the presence of molecular hydrogen at pressures and temperatures wherein at least part of the organic material is converted to lower molecular weight liquids and gases. One specific method of accomplishing this extraction is to treat the heavy bottoms stream in a second liquefaction zone under liquefaction conditions or, alternatively, to recycle a portion of the heavy bottoms to the original liquefaction zone where the bottoms are combined with the feed material and subjected to liquefaction conditions in the presence of the liquefaction solvent and/or molecular hydrogen The process of the invention results in the effective and efficient recovery of metal constituents from the insoluble metal-containing residues produced during the catalytic liquefaction of coal and similar carbonaceous materials. As a result, the invention makes possible a substantial savings in liquefaction processes carried out in the presence of metal-containing hydrogenation or liquefaction catalysts.

BRIEF DESCRIPTION OF THE DRAWING

The drawing is a schematic flow diagram of a catalytic liquefaction process in which metal constituents of the catalyst are recovered and reused in the process in accordance with the invention.

DESCRIPTION OF THE PREFERRED EMBODIMENTS

The process depicted in the drawing is one for the liquefaction of bituminous coal, subbituminous coal, lignitic coal, coal char, organic wastes, oil shale, petroleum residua, liquefaction bottoms, tar sand bitumens and similar carbonaceous solids in the presence of a metal-containing hydrogenation or liquefaction catalyst. The metal constituents of the catalyst are normally selected from the group consisting of molybdenum, vanadium, tungsten, chromium, nickel, rhenium, ruthenium and the like. Preferably, the metal used as a constituent the catalyst will be molybdenum.

The solid feed material that has been crushed to a particle size of about 8 mesh or smaller on the U. S. Sieve Series Scale is passed through line 10 from a feed preparation plant or storage facility, not shown in the drawing, into feed preparation zone 12. Here the carbonaceous solids are mixed with a hydrocarbon solvent introduced into the feed preparation zone through line 14, partially liquefied coal or recycle liquefaction bottoms introduced through line 16 and a metal-containing solution supplied through line 18. The majority of the metal-containing solution is recycled through line 20 from the metal recovery portion of the process, which is described in more detail hereinafter. Any makeup metal-containing solution required may be introduced into line 20 via line 22. It is preferred that sufficient metal-containing solution be introduced into feed preparation zone 12 to provide from about 100 to about 20,000 ppm of the metal or mixture of metals based on the weight of coal or other carbonaceous solids fed into the preparation zone. From about 100 to about 1000 ppm is generally adequate.

The hydrocarbon solvent used to prepare the slurry in preparation zone 12 is preferably a non-hydrogen donor diluent which contains less than about 1.2 weight percent donatable hydrogen, based on the weight of the solvent. Such a non-hydrogen donor solvent may be a heavy hydrocarbonaceous oil or a light hydrocarbonaceous compound or mixture of compounds having an atmospheric pressure boiling point ranging from about 350° F. to about 1000° F., preferably from about 700° F. to about 1000° F. Examples of suitable heavy hydrocarbonaceous oils include heavy mineral oils, whole or topped petroleum crude oils, residual oils such as petroleum atmospheric tower residua and petroleum vacuum distillation tower residue, tars, shale oils, coal derived liquids and the like. Suitable light non-hydrogen donor diluents include aromatic compounds such as alkylbenzenes, alkylnaphthalenes, alkylated polycyclic aromatics and mixtures thereof and streams such as unhydrogenated creosote oil, intermediate product streams from catalytic cracking of petroleum feed stocks, coal derived liquids, shale oil and the like. Preferably, the non-hydrogen donor diluent will be a recycle solvent derived within the process by liquefying the carbonaceous feed material and then fractionating the effluent from the liquefaction zone.

In some instances, it may be desirable to use a hydrogen donor diluent as a solvent. Such diluents will normally contain at least 1.2 weight percent donatable hydrogen, based on the weight of the diluent. Preferably, the donatable hydrogen concentration will range between about 1.2 and about 3.0 weight percent. The hydrogen donor diluent employed will normally be derived within the process in the same manner as the preferred non-hydrogen donor diluent except that the stream will be externally hydrogenated before recycling to the slurry preparation zone. The hydrogen donor diluent will normally contain at least 20 weight percent of compounds that are recognized as hydrogen donors at elevated temperatures generally employed in coal liquefaction reactors. Representative compounds of this type include $C_{10}$–$C_{12}$ tetrahydronaphthalenes, $C_{12}$–$C_{16}$ acenaphthenes, di, tetra, and octahydroanthracenes, tetrahydroacenaphthenes, and other derivatives of partially hydrogenated aromatic compounds.

Sufficient hydrocarbon solvent is introduced into slurry preparation zone 12 to provide a weight ratio of solvent to carbonaceous feed solids of between about 0.4:1 and about 4:1, preferably from about 1.2:1 to about 1.8:1. Higher ratios may be required if the recycle rate of liquefaction bottoms introduced into the preparation zone through line 14 is relatively high. The slurry formed in the preparation zone is withdrawn through line 24, mixed with a hydrogen-containing gas, preferably molecular hydrogen, introduced into line 24 through line 26; preheated to a temperature above about 600° F.; and passed upwardly in plug flow through liquefaction reactor 28. The mixture of slurry and hydrogen-containing gas will contain from about 2 to about 15 weight percent, preferably from about 4 to about 9 weight percent hydrogen on a moisture-free solids basis. The liquefaction reactor is maintained at a temperature between about 650° F. and about 900° F., preferably between about 800° F. and about 880° F., and at a pressure between about 300 psig and about 3000 psig, preferably between about 1500 psig and about 2500 psig. Although a single liquefaction reactor is shown in the drawing as comprising the liquefaction zone, a plurality of reactors arranged in parallel or series can also be used, providing the temperature and pressure in each reactor remain approximately the same. Such will be the case if it is desirable to approximate a plug flow situation. The slurry residence time within reactor 28 will normally range between about 15 minutes and about 125 minutes, preferably between about 30 and about 70 minutes.

Within the liquefaction zone in reactor 28, the carbonaceous solids undergo liquefaction or chemical conversion to lower molecular weight constituents. The high molecular weight constituents of the solids are hydrogenated and broken down to form lower molecular weight gases and liquids. The metal constituents which were previously introduced into the mixing zone through line 18 are converted into a hydrogenation or a liquefaction catalyst in situ. This metal-containing catalyst promotes the in situ hydrogenation of the hydrocarbon solvent to convert aromatics into hydroaromatics thereby increasing the donatable hydrogen content in the solvent. This, in turn, results in an increased conversion of the feed solids into lower molecular weight liquids. The metal-containing catalyst also promotes the direct hydrogenation of the solids structure and organic radicals generated by the cracking of the molecules comprising the carbonaceous solids.

The metal-containing compound or compounds in the solution introduced into feed preparation zone 12 can be any compound or compounds which will be converted under liquefaction conditions into metal constituents which are active hydrogenation or liquefaction catalysts. The metal itself may include any of the metals found in Group II-B, IV-B, V-B, VI-B, VII-B, and VIII of the Periodic Table of Elements. Such metals include molybdenum, vanadium, tungsten, chromium, nickel, rhenium, ruthenium, osmium and the like. The most preferred metal is molybdenum.

During the liquefaction process which takes place in liquefaction reactor 28, the metal constituents of the compounds introduced into the feed preparation zone are believed to be converted in situ into an active metal-containing hydrogenation or liquefaction catalyst. It is believed that the metal is converted into metal sulfides which then serve as the catalyst. Regardless of the chemistry that takes place in the liquefaction zone, the metal is converted into metal-containing compounds that are insoluble in common organic or inorganic solvents and exit the liquefaction zone with the heavy materials produced therein. To improve the economics of the liquefaction process described above in which insoluble metal-containing catalyst residues are formed, it is desirable to recover as much as possible of the metal constituents from the insoluble residues and reuse them as constituents of the catalyst in the liquefaction process, thereby decreasing the amount of costly makeup metal compounds needed. It has been found that a substantial amount of the metal constituents in the insoluble metal-containing catalyst residues withdrawn with the heavy bottoms from the liquefaction zone can be recovered for reuse by contacting at least a portion of the heavy bottoms, which will normally contain between about 10 weight percent and about 40 weight percent carbonaceous material, with an aqueous solution of a mineral acid in the presence of an added alcohol and an added oxidizing agent, such as hydrogen peroxide, thereby extracting the metal constituents from the insoluble catalyst residues into the aqueous solution and using the extracted constituents to supply the metal constituents that comprise the hydrogenation or liquefaction catalyst.

Referring again to the drawing, the effluent from liquefaction reactor 28, which contains gaseous liquefaction products such as carbon monoxide, carbon dioxide, ammonia, hydrogen, hydrogen sulfide, methane, ethane, ethlyene, propane, propylene and the like; unreacted hydrogen from the feed slurry; light liquids; and heavier liquefaction products including ash, unconverted carbonaceous solids, high molecular weight liquids and insoluble metal-containing catalyst residues, is withdrawn from the top of the reactor through line 30 and passed to separator 32. Here the reactor effluent is separated, preferably at liquefaction pressure, into an overhead vapor stream which is withdrawn through line 34 and a liquid stream removed through line 36. The overhead vapor stream is passed to downstream units where the ammonia, hydrogen and acid gases are separated from the low molecular weight gaseous hydrocarbons, which are recovered as valuable byproducts. Some of these light hydrocarbons, such as methane and ethane, may be steam reformed to produce hydrogen that can be recycled where needed in the process.

The liquid stream removed from separator 32 through line 36 will normally contain low molecular weight liquids, high molecular weight liquids, mineral matter or ash, unconverted carbonaceous solids and insoluble metal-containing catalyst residues. This stream is passed through line 36 into a fractionating zone 38 where the separation of low molecular weight liquids from the high molecular weight liquids boiling above about 1000° F. and solids is carried out. Normally, the fractionation zone will be comprised of an atmospheric distillation column in which the feed is fractionated into an overhead fraction composed primarily of gases and naphtha constituents boiling up to about 350° F. and intermediate liquid fractions boiling within the range from about 350° F. to about 700° F. The bottoms from the atmospheric distillation column is then passed to a vacuum distillation column in which it is further distilled under reduced pressure to permit the recovery of an overhead fraction of relatively light liquids and heavier intermediate fractions boiling below 850° F. and 1000° F. Several of the distillate streams from both the atmospheric distillation column and the vacuum distillation column are combined and withdrawn as product from the fractionation zone through line 40. A portion of the liquids produced in the fractionation zone is also withdrawn through line 42 and recycled through line 14 for use as the hydrocarbon solvent in slurry preparation zone 12. Normally, these liquids will have a boiling range from about 350° F. to about 1000° F.

The heavy bottoms from the vacuum distillation column, which consists primarily of high molecular weight liquids boiling above about 1000° F., mineral matter or ash, unconverted carbonaceous solids and insoluble metal-containing catalyst residues, is withdrawn from fractionation zone 38 through line 44. A portion of this heavy bottoms stream, normally between about 10 and about 70 weight percent of the stream, is recycled to slurry preparation zone 12 through lines 46 and 16. The remaining portion of the bottoms stream is passed through line 48 into extraction zone 50. The bottoms will contain a lower amount of carbonaceous material as compared to bottoms withdrawn from a system in which there is no recycle of the bottoms to the liquefaction zone. Because of the lower amount of carbonaceous material present, it has been found that the metal constituents in the insoluble catalyst residues present in the bottoms can be more easily extracted with an aqueous solution of an inorganic mineral acid. It has also been discovered that this extraction can be greatly enhanced if it is carried out in the presence of an added alcohol and oxidizing agent.

Referring again to the drawing, the bottoms from line 48 is first cooled to form a solid product, crushed or pulverized into smaller particles in equipment not shown in the drawing and passed into extraction zone 50. Here the solids are contacted with an aqueous solution containing a mineral acid, an alcohol and an oxidizing agent introduced into the extraction zone through line 52. During the contacting process that takes place in the extraction zone, the aqueous acid solution extracts metal constituents from the insoluble catalyst residues in the bottoms fed to the extraction zone in the form of water-soluble, metal-containing compounds, which are most likely the metal salts or metal oxysalts of the mineral acid. The extraction zone will normally comprise a single-stage or multistage countercurrent extraction system in which the solids are countercurrently contacted with the aqueous acid solution introduced through line 52. Spent solids from which the metal constituents have been substantially removed are withdrawn from the extraction zone through line 54 and may be disposed of as landfill or used for other purposes The acid used in the extraction may be any inorganic mineral acid with a relatively high ionization constant. Examples of such acids include sulfuric acid, hydrochloric acid, phosphoric acid, nitric acid and the like. Normally, the acid is used in a strength ranging between about 0.2 normal and about 12.0 normal. The oxidizing agent utilized may be peracids such as peracetic acid; hydroperoxides such as hydrogen peroxide and tertiary butyl hydrogen peroxide; and peroxides such as tertiary butyl peroxide, acetone peroxide and the like. The most perferred oxidizing agent will normally be hydrogen peroxide. Normally, the oxidizing agent is present in the aqueous acid solution in a concentration ranging between about 0.1 weight percent and about 5.0 weight percent, preferably between about 0.2 and about 0.5 weight percent.

The alcohol utilized in the extraction may be straight or branched chain aliphatic alcohols containing between 1 and 10 carbon atoms such as methanol, ethanol, propanol, butanol, and the like. The alcohol may also be a cycloaliphatic alcohol containing between 5 and 10 carbon atoms such as cyclohexanol. Preferably, the alcohol utilized will be a straight chain aliphatic alcohol containing between 1 and 4 carbon atoms. Methanol is the most preferred alcohol for use in the extraction step. In general, the aqueous acid solution introduced into extraction zone 50 through line 52 will contain between about 0.1 and about 10.0 weight percent, preferably between about 0.2 and about 2.0 weight percent of the alcohol. The temperature in the extraction zone will normally be maintained between about 50° F. and 500° F., preferably between about 80° F. and about 212° F. The pressure in the extraction zone will normally range between about 0 psig and about 1000 psig. The residence time of the solids in the extraction zone will depend upon the temperature and the acid employed and will normally range between about 1 minute and about 250 minutes, preferably between about 3 minutes and about 100 minutes.

As mentioned previously, the presence of the oxidizing agent and the alcohol in the extraction zone results in a surprising increase in the amount of metal that can be extracted from the insoluble catalyst residues in the bottoms fed to the extraction zone. The reasons for this are not fully understood, however, it is believed that the alcohol provides for better contact between the solids and the aqueous acid solution thereby helping to overcome the hydrophobicity of the bottoms fed to the extraction zone. Also, it is believed that the oxidizing agent helps to maintain the metal constituents in their highest oxidation state so that they can be more easily extracted from the insoluble catalyst residues.

Under the conditions in extraction zone 50, between about 90 and about 100 percent of the metal in the insoluble catalyst residues fed to the extraction zone with the bottoms through line 48 will be extracted into the aqueous solution. The actual amount of the metal extracted will depend upon the strength of the acid used to form the solution, the oxidizing agent utilized, the alcohol present and the extraction conditions. Normally, a portion of the alumina, silica and other constituents of the mineral matter present in the bottoms will also be extracted into the aqueous solution. In order to reuse the metal constituents solublized in the extraction zone as constituents of the catalyst in liquefaction zone 28, it is necessary to selectively recover these metal constituents from the aqueous solution, which also contains solubilized mineral matter constituents. One method of accomplishing this is to utilize a liquid-liquid extraction in the presence of a suitable extraction agent.

Referring again to the drawing, the aqueous solution containing the extracted metal and mineral matter constituents exiting extraction zone 50 is passed through line 56 into mixing tank 58. Here the aqueous solution is mixed with a hydrocarbon solvent, preferably a portion of the liquids recycled to feed preparation zone 12 from separation zone 38 through lines 42 and 14, which is introduced into mixing tank 58 through line 60. The hydrocarbon solvent and the aqueous solution are agitated together in the tank in the presence of an extraction agent introduced into the tank through line 62. The extraction agent may be any compound which will form a complex with the metal in the aqueous phase that is soluble in the hydrocarbon solvent. The effect of the extraction agent will be to transfer the metal constituents from the aqueous phase to the organic phase. When the metal constituent is molybdenum, suitable extraction agents will be esters of phosphoric acid such as tributyl phosphate and alkyl phosphoric acids; and trialkylamines, such as trilaurylamine and the like. Normally, a sufficient amount of the extraction agent is introduced into mixing tank 58 so that the concentration of the agent ranges between about 0.5 and about 25.0 weight percent. Although the hydrocarbon liquid normally used is a portion of the liquids recycled to feed preparation zone 12, any hydrocarbon solvent can be used including straight and branched chain aliphatic and alicyclic compounds, aromatic compounds, and the like.

After the mixture of liquids in mixing tank 58 has been agitated for a sufficient amount of time, the contents of the tank are allowed to stand undisturbed so that the aqueous and organic phases can separate. The organic phase, which will rise to the top of the tank, will contain the extracted metal constituents and is withdrawn from the top of mixing tank 58 through line 64 and returned to feed preparation zone 12 via lines 20 and 18. Here the metal constituents serve as the precursors of the metal-containing hydrogenation or liquefaction catalyst that is formed in situ in liquefaction reactor 28. If a substantial amount of the metal constituents in the bottoms withdrawn from fractionation zone 38 is not recovered in the process, makeup metal constituents dissolved in an appropriate organic diluent can be introduced into line 20 through line 22. Normally, the compounds used to supply makeup metal constituents will be metal salts of straight or branched chain aliphatic carboxylic acids, metal salts of alicyclic or aliphatic carboxylic acids, heteropolyacids, hydrated oxides, carbonyls, phenolates, and organo amine salts. The most preferred types of metal compounds are heteropoly acids such as phosphomolybdic acid and salts of alicyclic or aliphatic carboxylic acids such as metal naphthenates.

In the embodiment of the invention shown in the drawing and described above, the feed to extraction zone 50 contains liquefaction bottoms that has been recycled at least once through liquefaction zone 28 to reduce its organic content. It will be understood that the process of the invention is applicable to recovering metal constituents from liquefaction bottoms whose organic or carbonaceous content has been decreased, normally into a range between about 10 and about 40 weight percent, via other methods. For example, instead of recycling bottoms through line 46, once-through bottoms from fractionation zone 38 could be passed to a second liquefaction zone and subjected to liquefaction conditions in the presence of a fresh hydrocarbon solvent and/or a hydrogen-containing gas in order to further convert the bottoms into liquids and/or gases and thereby reduce its organic content. Also, any type of alternative extraction in which organic material is removed from the liquefaction bottoms can be utilized. If solvent extraction in a second liquefaction zone is used, it will normally be carried out at a temperature between about 700° F. and about 900° F., preferably between about 750° F. and about 850° F. and at a pressure between about 350 psig and about 2500 psig, preferably between about 1000 psig and about 2000 psig. The solvent to bottoms ratio will range between about 0.5:1 and about 10:1. In general, the residence time will be between about 20 minutes and about 180 minutes, preferably between about 40 minutes and about 120 minutes.

The nature and objects of the invention are further illustrated by the results of laboratory tests. The first series of tests illustrates that aqueous acids will extract virtually no metal constituents from once-through coal liquefaction bottoms. As used herein, the phrase "once-through coal liquefaction bottoms" refers to the heavy product (normally boiling above 1000° F.) produced by subjecting coal and similar solid carbonaceous material to liquefaction conditions in the presence of a solvent and/or a hydrogen-containing gas but not in the presence of recycle bottoms. The second series of tests illustrates that substantial quantities of metal constituents can be recovered from the insoluble catalyst residues comprising the once-through heavy bottoms product from liquefaction carried out in the presence of a metal-containing catalyst by first treating the once-through bottoms to reduce its organic content and subsequently leaching the resultant bottoms of reduced organic content with an aqueous acid solution in the presence of an alcohol and an oxidizing agent.

In the first series of tests, 0.2 to 0.5 gram samples of the once-through heavy bottoms product produced via the catalytic liquefaction of an Illinois No. 6 coal in the presence of molybdenum were refluxed at 212° F. with aqueous solutions of various mineral acids for two to three minutes. The resultant slurries were then filtered and the solid residue was washed with deionized water and diluted to standard volumes. The resultant solutions from the refluxing and washing were analyzed for molybdenum by inductively coupled plasma emissions spectroscopy (ICPES). The heavy bottoms used in this series of tests was prepared by contacting Illinois No. 6 coal with coal derived liquids in the presence of hydrogen at a temperature of about 840° F. and a pressure of about 2200 psig. The results of these tests are set forth as runs 1 through 3 in Table 1. As can be seen, the aqueous acid solutions extracted less than 9 ppm of molybdenum from the bottoms.

In the second series of tests, several samples of once-through coal liquefaction bottoms produced in the same manner as described in the first series of tests and containing molybdenum were slurried with tetralin and pressurized in an autoclave to about 1000 psig in the presence of hydrogen or a 2:1 mixture of hydrogen and carbon monoxide. The slurries were stirred for about 180 minutes at about 800° F. After the slurries cooled, they were filtered and the residues were washed with methylene chloride and dried. Methylene chloride was distilled off from the filtrates and the residual oils distilled. The original samples of once-through bottoms contained 62.7 weight percent carbon. The high temperature and pressure solvent extraction described above removed about 90.0 weight percent of the carbon originally in the once-through bottoms samples. Two-tenths to 1.0 gram samples of each of the residues thus produced were then refluxed at about 212° F. in aqueous solutions of various acids for about 3 minutes. The resultant slurries were filtered and the residues washed with deionized water. The solutions from the filtering and the washings were analyzed for molybdenum by ICPES. In some runs, the solution used for refluxing contained a few drops of hydrogen peroxide. In other runs, the residues were wetted with a few drops of methanol before refluxing. Finally, in some runs both hydrogen peroxide and methanol or other lower molecular weight alcohol were present during refluxing. The results of these tests are set forth as runs 4 through 18 in Table 1.

As can be seen from runs 4 through 7 in Table 1, the amount of molybdenum that is removed from the extracted bottoms by the acid solutions alone tends to be larger than the amount removed from the nonextracted bottoms (runs 1 through 3). The percentage of molybdenum extracted, however, is still very low. Also, phosphoric acid appears to extract much less than either sulphuric or hydrochloric acid. Runs 8 through 12 indicate that the amount of molybdenum removed from the extracted bottoms can be substantially increased by carrying out the leaching in the presence of added hydrogen peroxide. The percent of molybdenum removed from the extracted bottoms, however, is still relatively low. A comparison of run 13 with run 7 indicates that carrying out the leaching in the presence of added methanol does not significantly increase the amount molybdenum removed from the extracted bottoms. Runs 14 through 16 surprisingly indicate that if the acid leaching of the extracted bottoms is carried out in the presence of both hydrogen peroxide and methanol, the

TABLE 1

RECOVERY OF MOLYBDENUM FROM COAL LIQUEFACTION BOTTOMS

| Run Number | Bottoms Extracted | *Mo in Bottoms (ppm) | Leaching Solution | Mo Found In Leaching Solution (ppm) | % Mo Removed |
|---|---|---|---|---|---|
| 1 | No | 3500 | 5 Wt. % $H_2SO_4$ | 9 | 0.3 |
| 2 | No | 3500 | 10 Wt. % $H_3PO_4$ | <5 | Nil |
| 3 | No | 3500 | 5 Wt. % HCl | <5 | Nil |
| 4 | Yes | 5650 | 15 Wt. % $H_2SO_4$ | 77.2 | 1.4 |
| 5 | Yes | 5650 | 10 Wt. % $H_3PO_4$ | <4 | Nil |
| 6 | Yes | 5650 | 5 Wt. % HCl | 92.3 | 1.6 |
| 7 | Yes | 5120** | 10 Wt. % $H_2SO_4$ | 59 | 1.2 |
| 8 | Yes | 5120** | 10 Wt. % $H_3PO_4 + H_2O_2$ | 632 | 12.3 |
| 9 | Yes | 5120** | 10 Wt. % $H_3PO_4 + H_2O_2$ | 665 | 13.0 |
| 10 | Yes | 4730 | 10 Wt. % $H_3PO_4 + H_2O_2$ | 139 | 2.9 |
| 11 | Yes | 4730 | 10 Wt. % $H_3PO_4 + H_2O_2$ | 179 | 3.8 |
| 12 | Yes | 5120** | 10 Wt. % $H_2SO_4 + H_2O_2$ | 1350 | 26.0 |
| 13 | Yes | 5120** | 10 Wt. % $H_2SO_4 + CH_3OH$ | 69 | 1.4 |
| 14 | Yes | 4730 | 10 Wt. % $H_3PO_4 + H_2O_2 + CH_3OH$ | 4310 | 91.0 |
| 15 | Yes | 4730 | 10 Wt. % $H_3PO_4 + H_2O_2 + CH_3OH$ | 3900 | 83.0 |
| 16 | Yes | 5120** | 10 Wt. % $H_2SO_4 + H_2O_2 + CH_3OH$ | 5210 | 100+ |
| 17 | Yes | 5120** | 10 Wt. % $H_2SO_4 + H_2O_2 + C_2H_5OH$ | 5060 | 99 |
| 18 | Yes | 5120** | 10 Wt. % $H_2SO_4 + H_2O_2 + C_4H_9OH$ | 5500 | 100+ |

*If the bottoms was extracted, the number in this column represents the molybdenum in the extracted bottoms.
**The high temperature and pressure extraction that produced these bottoms was carried out in the presence of 0.5 grams of carbon disulfide.

amount of molybdenum recovered is greatly increased. Runs 17 and 18 indicate that similar high levels of molybdenum removal are obtained when using higher molecular weight alcohols such as ethanol and butanol in lieu of methanol. The data in Table 1 clearly indicate that near complete recoveries of molybdenum can be made from once-through coal liquefaction bottoms by first reducing the organic content of the bottoms and subsequently leaching the bottoms with an aqueous acid solution in the presence of an added alcohol and an added oxidizing agent.

It will be apparent from the foregoing that the invention provides a process which makes it possible to recover metal constituents from insoluble metal-containing catalyst residues formed during the liquefaction of coal and similar carbonaceous solids in the presence of a metal-containing catalyst. As a result, the need for costly makeup compounds containing metal constituents is reduced, thereby lowering the overall cost of the liquefaction process.

We claim:

1. In a process for the liquefaction of carbonaceous solids wherein said solids are contacted under liquefaction conditions in a liquefaction zone with molecular hydrogen in the presence of a catalyst containing metal constituents to produce a liquefaction effluent, and said liquefaction effluent is treated to recover hydrocarbon liquids thereby producing a heavy bottoms containing carbonaceous material, insoluble catalyst residues containing said metal constituents and ash, the improvement which comprises:

(a) reducing the organic content of said heavy bottoms to produce a heavy bottoms deficient in carbonaceous material and containing said insoluble catalyst residues and said ash;

(b) contacting at least a portion of said heavy bottoms deficient in carbonaceous material produced in step (a) with an aqueous solution of a mineral acid in the presence of an added alcohol and an added oxidizing agent selected from the group consisting of peracids, hydroperoxides and peroxides, thereby extracting said metal constituents from said insoluble catalyst residues into said aqueous solution; and (c) using the metal constituents extracted in step (b) as constituents of said catalyst.

2. A process as defined by claim 1 wherein the organic content of said heavy bottoms is reduced by contacting said heavy bottoms with a hydrocarbon solvent and molecular hydrogen under solvent extraction conditions to convert at least a portion of the carbonaceous material in said heavy bottoms into liquids and/or gases, thereby forming a heavy bottoms deficient in carbonaceous material and containing said insoluble catalyst residues and ash.

3. A process as defined by claim 1 wherein said carbonaceous solids comprise coal.

4. A process as defined by claim 1 wherein the organic content of said heavy bottoms is reduced by recycling at least a portion of said bottoms to said liquefaction zone.

5. In a process for the liquefaction of coal wherein said coal is contacted under liquefaction conditions in a liquefaction zone with molecular hydrogen and an added hydrocarbon solvent in the presence of a catalyst containing metal constituents and in the presence of partially liquefied coal to produce a liquefaction effluent and said liquefaction effluent is treated to recover hydrocarbon liquids thereby producing a heavy bottoms containing carbonaceous material, insoluble catalyst residues containing said metal constituents and ash, the improvement which comprises:

(a) recycling at least a portion of said heavy bottoms to said liquefaction zone as said partially liquefied coal;

(b) contacting another portion of said heavy bottoms with an aqueous solution of a mineral acid in the presence of an added alcohol and an added oxidizing agent selected from the group consisting of peracids, hydroperoxides and peroxides, thereby extracting said metal constituents from said insoluble catalyst residues into said aqueous solution; and (c) using the metal constituents extracted in step (b) as constituents of said catalyst.

6. A process as defined by claims 1 or 5 wherein said catalyst contains a metal from Group II-B, Group IV-B, Group V-B, Group VI-B, Group VII-B, or Group VIII of the Periodic Table of Elements.

7. A process as defined by claims 1 or 5 wherein said catalyst contains a metal selected from the group consisting of molybdenum, vanadium, tungsten, chromium, rhenium, ruthenium, and nickel.

8. A process as defined by claim 7 wherein said metal comprises molybdenum.

9. A process as defined by claims 1 or 5 wherein said mineral acid is selected from the group consisting of sulphuric acid, hydrochloric acid, phosphoric acid, and nitric acid.

10. A process as defined by claim 1 or 5 wherein said oxidizing agent comprises hydrogen peroxide.

11. A process as defined by claims 1 or 5 wherein said alcohol is selected from the group consisting of straight and branched chain aliphatic alcohols containing between 1 and 10 carbon atoms and cycloaliphatic alcohols containing between 5 and 10 carbon atoms.

12. A process as defined by claim 11 wherein said alcohol is methanol, ethanol, propanol, or butanol.

13. A process as defined by claims 1 or 5 wherein said catalyst contains molybdenum, said oxidizing agent comprises hydrogen peroxide and said alcohol comprises methanol.

14. A process as defined by claims 1 or 5 wherein the aqueous solution containing extracted metal constituents produced in step (b) is mixed with a hydrocarbon liquid in the presence of an extraction agent which forms an organic-soluble metal complex with said metal constituents thereby transferring said metal constituent from said aqueous solution into said hydrocarbon liquid, and wherein said hydrocarbon liquid is then recycled to said liquefaction zone where said metal constituents are used as constituents of said catalyst.

15. A process as defined by claim 14 wherein said catalyst contains molybdenum and said extraction agent comprises an ester of phosphoric acid.

* * * * *